United States Patent [19]

Urakami

[11] Patent Number: 4,719,659

[45] Date of Patent: Jan. 19, 1988

[54] ROTARY TRAVELLING SURFACE TREATMENT DEVICE

[76] Inventor: Fukashi Urakami, 5-21-204 Konandai 4-chome, Konan-ku, Yokohama, Japan

[21] Appl. No.: 943,459

[22] Filed: Dec. 19, 1986

[30] Foreign Application Priority Data

Dec. 28, 1985 [JP] Japan ..... 60-299204

[51] Int. Cl.[4] ..... A47L 11/16

[52] U.S. Cl. ..... 15/49 R; 51/177; 404/112

[58] Field of Search ..... 15/49 R, 50 R, 98, 385; 51/177; 404/112; 144/119 R, 119 A

[56] References Cited

U.S. PATENT DOCUMENTS

| | | | |
|---|---|---|---|
| 1,069,803 | 8/1913 | Nelson et al. | 51/177 |
| 1,663,759 | 3/1928 | Ham | 51/177 X |
| 2,288,782 | 7/1942 | Brown | 51/177 X |
| 4,485,517 | 12/1984 | Voigt | 15/49 R X |

*Primary Examiner*—Edward L. Roberts

*Attorney, Agent, or Firm*—Beveridge, DeGrandi & Weilacher

[57] ABSTRACT

A rotary travelling device comprising a main supporting member rotatably around a first axis substantially perpendicular to a travelling surface, a subsidiary supporting member mounted on the main supporting member for free rotation around a second axis substantially parallel to the first axis, a rotary disc mounted rotatably on the subsidiary member, and a driving means for rotating the rotary disc. The central axis of rotation of the rotary disc is not perpendicular but inclined to the travelling surface, and the under surface of the rotary disc comes into inclined contact with the travelling surface. The device is further provided with means for rotating the subsidiary member around the second axis according to the rotation of the main supporting member around the first axis.

10 Claims, 9 Drawing Figures

F-PT
FA-P
FC-P
FB-P

III
24
60b
6b
FB-R
FB
FB-P
B
12b
4b
50
44b
10b
58b
52
ℓ
FC-P
C
4c
6c
FC
44c
10c
50
FC-R
12c
60c
58c
IV
F-PT
β
ℓ
20
54
84
56
ℓ
α
2
10a
58a
60a
66a
68a
66a
50
4a
A
III
FA-P
FA
FA-R
γ
12a
44a
6a
IV

ROTARY TRAVELLING SURFACE TREATMENT DEVICE

BACKGROUND OF THE INVENTION

1. Field of the Invention

This invention relates to a unique rotary travelling device in which a supporting member travels along a travelling surface while rotating around an axis substantially perpendicular to the travelling surface. This rotary travelling device is suitable for carrying out a treatment such as grinding or cleaning on a travelling surface.

2. Description of the Prior Art

In the construction of dams, for example, concrete is placed repeatedly a number of times until the desired height is attained. The thickness of concrete placed each time is about 30 cm. Hence, in order to construct a dam having a height of 100 meters, concrete should be placed repeatedly more than 300 times. In such dam construction, the surface of the placed concrete should be ground (this grinding is generally called "green cut") before the next concrete is placed. Otherwise, the placed concrete and the next concrete are not bonded as required. The surface of the placed concrete is ground by a surface grinding device having a rotating disc provided with a wire brush at its under surface.

The conventional surface grinding device does not have a self-travelling function, and the operator should properly move the surface grinding device along the surface of the concrete to be ground. Since the rotating disc having a wire brush in contact with the concrete surface is rotated, the movement of the surface grinding device by the operator is not easy and is unstable. Accordingly, the grinding of the concrete surface in the past is a complex operation requiring much labor. Furthermore, it is extremely difficult, if not impossible, to ground the entire concrete surface uniformly.

SUMMARY OF THE INVENTION

It is an object of this invention to provide a novel and excelent device which permits creation of a self-travelling function by the rotation of a rotary disc used for surface treatment without the need for an expensive self-travelling means, and which can be conveniently used in the treatment of a relatively broad surface, for example, in the grinding of a concrete surface, or the cleaning of a surface such as a road surface or a floor in a building.

Another object of this invention is to provide a novel and excellent device of the type described above in which the self-travelling direction is controlled very easily.

According to this invention, there is provided a rotary travelling device comprising

- a main supporting member rotatable around a first axis extending substantially perpendicularly to a travelling surface,
- a subsidiary supporting member mounted on the main supporting member for free rotation around a second axis extending substantially parallel to the first axis,
- a rotary disc mounted on the subsidiary supporting member for free rotation around a third axis extending inclinedly to the second axis, the under surface of the rotary disc being adapted to come into inclined contact with the travelling surface,

- a driving means for rotating the rotary disc around the third axis, and
- means for rotating the subsidiary supporting member around the second axis according to the rotation of the main supporting member around the first axis.

In the rotary travelling device of this invention, rotation of the rotary disc around the third axis causes the main supporting member to rotate around the first axis. As a result, the subsidiary supporting member is rotated around the second axis. The rotation of the rotary disc and the consequent rotation of the main supporting member and the subsidiary supporting member produce a propelling force in a predetermined direction to cause the entire device to travel in the predetermined direction.

In a preferred embodiment of this invention, the means for rotating the subsidiary supporting member includes an arm mounted on the main supporting member for free rotation around the first axis relative to the main supporting member. To the arm is connected a travelling direction controlling handle for rotating the arm around the first axis. In this preferred embodiment, the self-travelling direction of the device can be controlled by operating the handle and thus rotating the arm.

DETAILED DESCRIPTION OF PREFERRED EMBODIMENTS

Preferred embodiments of the rotary travelling device in accordance with this invention will be described in detail with reference to the accompanying drawings.

Figure 1:
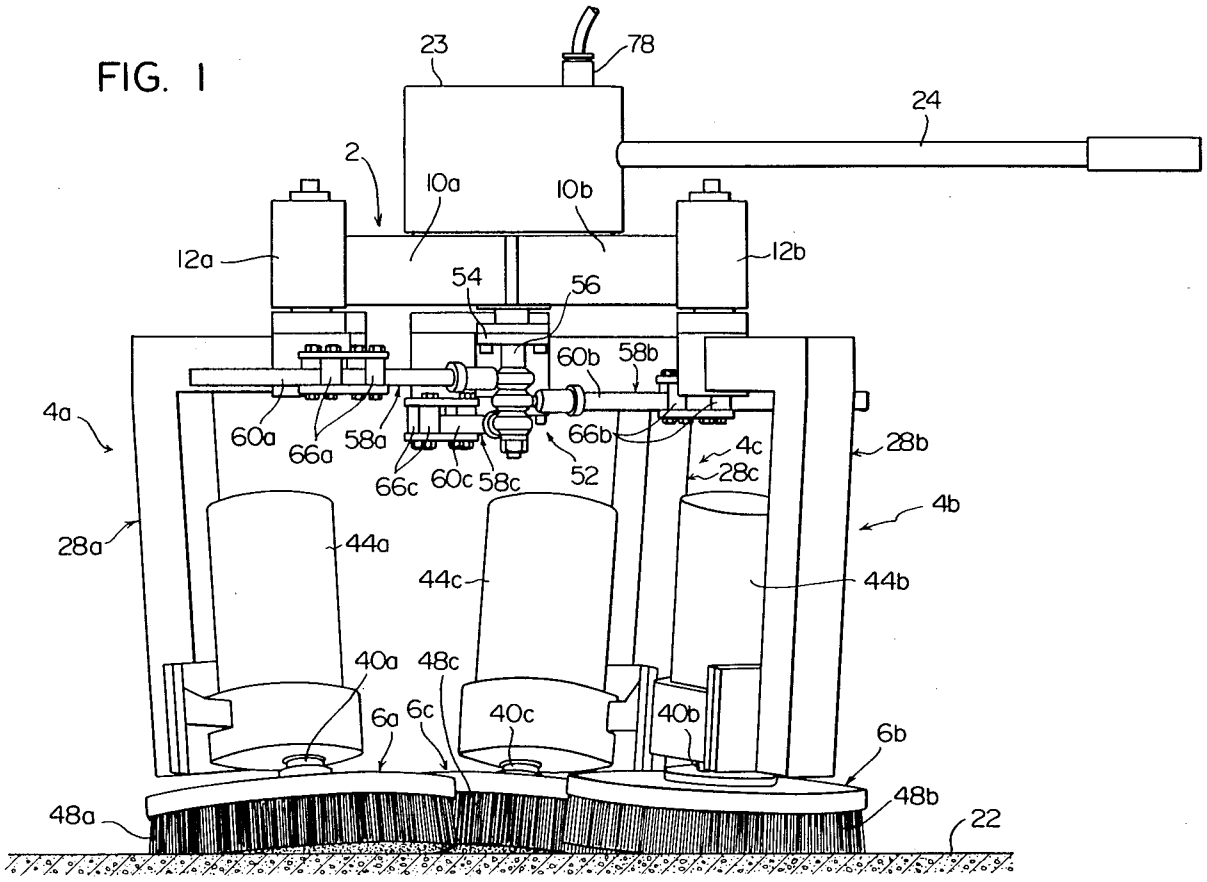
FIG. 1 is a side elevation showing preferred embodiment of the rotary travelling device constructed in accordance with this invention.

With reference to FIG. 1, the illustrated rotary travelling device includes a main supporting member 2, three subsidiary members **4*a*, 4*b* and 4*c* mounted on the main supporting member 2, and three rotary discs 6*a*, 6*b* and 6*c* mounted respectively on the subsidiary supporting members 4*a*, 4*b* and 4*c***.

Figures 2, 5:
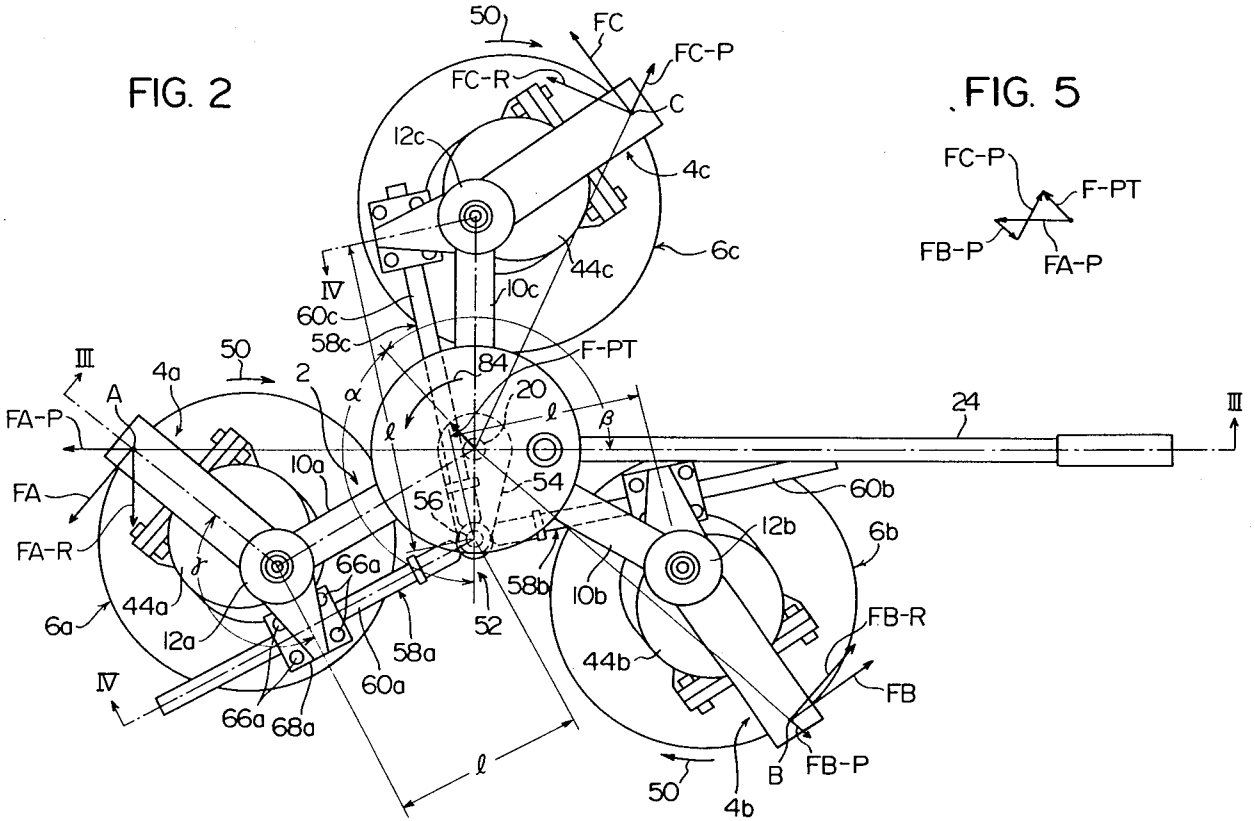
FIG. 2 is a top plan view of the rotary travelling device of FIG. 1.
FIG. 5 is a vector diagram for illustrating the propelling forces in the rotary travelling device of FIG. 1.
Figure 3:
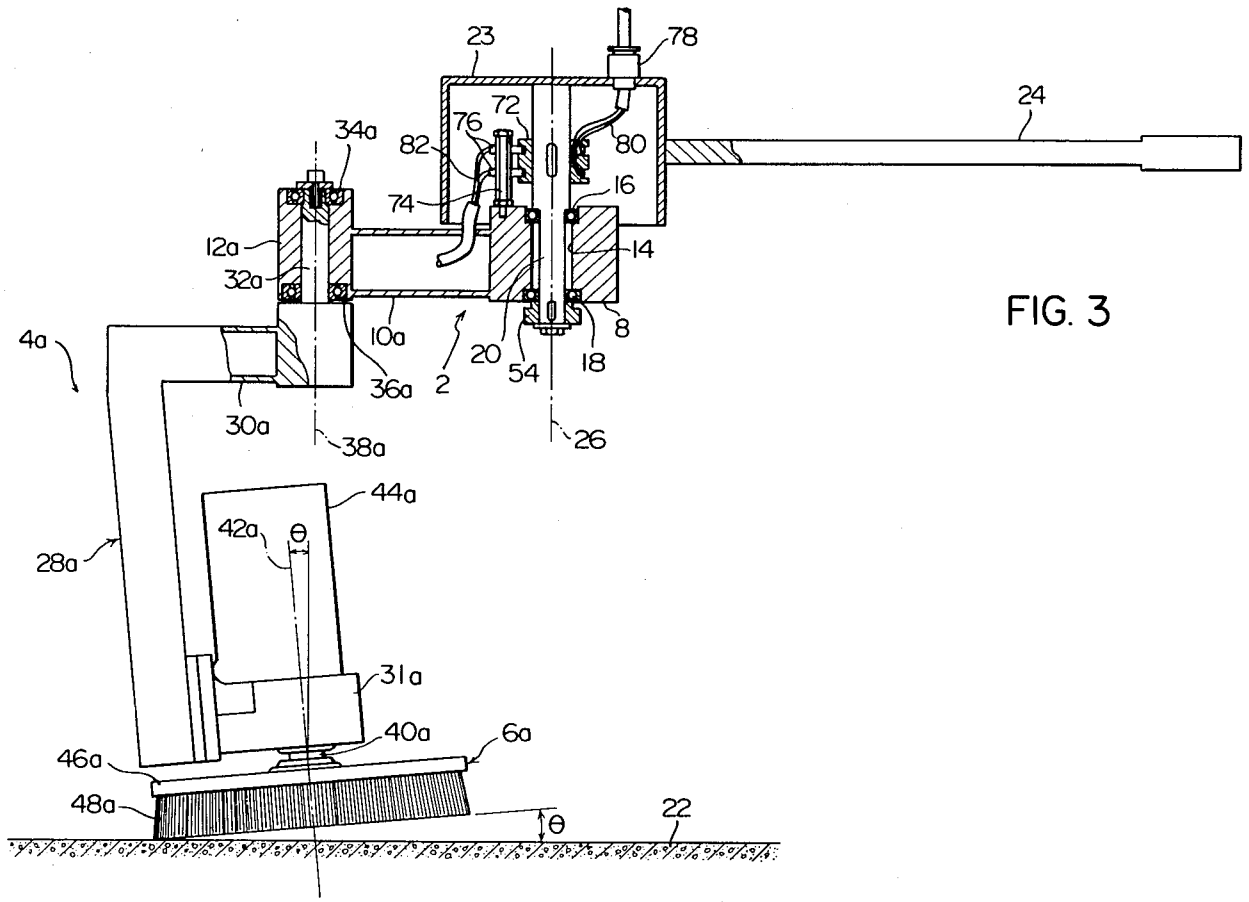
FIG. 3 is a sectional view taken along line III—III of FIG. 2.

With reference to FIGS. 2 and 3 taken in conjunction with FIG. 1, the main supporting member 2 has a central hub portion 8, three supporting arms **10*a*, 10*b* and 10*c* extending radially from the central hub portion 8** and terminal hub portions 12a, 12b and 12c formed respectively on the free ends of the supporting arms 10a, 10b and 10c. The supporting arms 10a, 10b and 10c are disposed at substantially equal angular (120°) intervals, and have substantially the same length. As clearly shown in FIG. 3, a through-hole 14 is formed in the central hub portion 8 of the main supporting member 2, and a main shaft 20 is fitted in the through-hole 14 via bearing means 16 and 18. The main shaft 20 extends substantially perpendicularly to a travelling surface 22 which may be the surface of concrete to be ground. An inverted cup-shaped cover member 23 is fixed to the upper end of the main shaft 20. To the side surface of the cover member 23 is fixed the inside end of a travelling direction controlling handle 26 extending radially outwardly. As will be described in detail hereinafter, the main supporting member 2 is rotated around a first axis 26 (i.e., the central axis of the main shaft 20) extending substantially perpendicularly to the travelling surface 22.

The three subsidiary supporting members 4a, 4b and 4c are substantially the same. With reference to FIGS. 1 to 3, particularly FIG. 3, the subsidiary supporting member 4a will be described. The subsidiary supporting member 4a has a nearly C-shaped frame 28a provided with an upper arm portion 30a and a lower arm portion 31a. A subsidiary shaft 32a extending upwardly in substantially vertical relationship with respect to the travelling surface 22 is formed on the free end of the upper arm portion 30a. The subsidiary shaft 32a is mounted rotatably on the terminal hub portion 12a of the main supporting member 2 via bearing means 34a and 36a. Thus, the subsidiary supporting member 4a is mounted on the main supporting member 2 such that it is free to rotate around a second axis 38a extending substantially perpendicularly to the travelling surface 22 (i.e., around the central axis of the subsidiary shaft 32a). The lower arm portion 31a has rotatably mounted thereon a rotating shaft 40a via a bearing means (not shown). It is critical that the rotating shaft 40a is inclined to the first axis 26 and the second axis 38a, and therefore to the travelling surface 22. In the illustrated embodiment, the central axis of the rotating shaft 30a, i.e. a third axis 42a, extends downwardly such that it is inclined radially inwardly at an inclination angle $\theta$. The inclination angle $\theta$ is, for example, about 5 degrees. A driving means 44a which may be an electric motor is mounted on the upper surface of the lower arm portion 31a. The output shaft (not shown) of this driving means 44a is linked to the rotating shaft 40a. The rotating shaft 40a projects downwardly beyond the lower arm portion 31a, and the rotating disc 6a is fixed to its lower end. In the illustrated embodiment, the rotating disc 6a is comprised of a circular base plate 46a fixed to the lower end of the rotating shaft 40a and a wire brush 48a provided on the under surface of the base plate 46a. ; *The wire brush 48a* is composed of a number of fine wires implanted in the under surface of the base plate 46a. As shown clearly in FIG. 3, the under surface of the rotary disc 6a, and therefore the wire brush 48a, come into contact with the travelling surface 22 inclinedly at the inclination angle $\theta$. As will be stated further hereinafter, when the driving means 44a is energized, the rotating shaft 40a and the rotating disc 6a fixed to it are rotated in the direction shown by an arrow 50 in FIG. 2.

The subsidiary supporting member 4b and the rotating shaft 40b, driving means 44b and the rotating disc 6b mounted on it, and the subsidiary supporting member 4c and the rotating shaft 40c, driving means 44c and the rotating disc 6c mounted on it are substantially the same as the subsidiary supporting member 4a and the rotating shaft 40a, the driving means 44a and the rotating disc 6a mounted on it. Hence, a description of these subsidiary members 4b and 4c and the related parts will be omitted.

Figure 4:
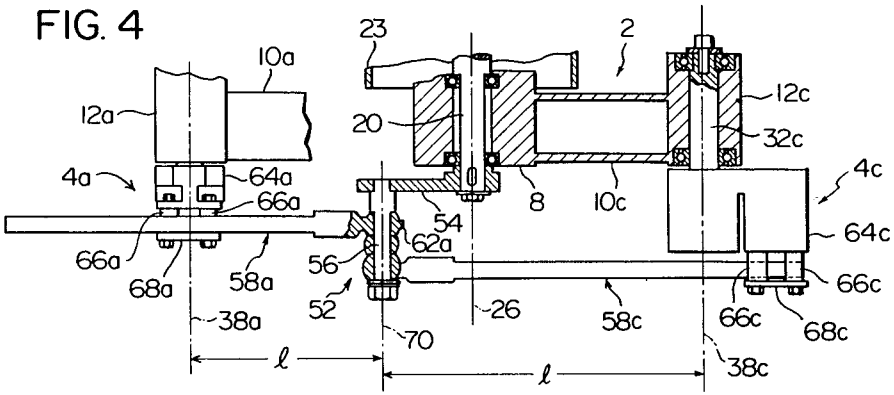
FIG. 4 is a sectional view of the line IV—IV of FIG. 2.

The rotary travelling device illustrated further includes a subsidiary supporting member rotating means shown generally at 52. With reference to FIG. 4 taken in conjunction with FIGS. 1 and 2, the main shaft 20 projects downwardly beyond the under surface of the central hub portion 8 of the main supporting member 2, and a radially outwardly projecting arm 54 is fixed to its lower end portion. A downwardly extending pin 56 is fixed to the free end portion of the arm 54. The pin 56 extends substantially parallel to the main shaft 20. The subsidiary supporting member rotating means 52 further includes three linking means 58a, 58b nd 58c for linking the pin 56 to each of the three subsidiary supporting members 4a, 4b and 4c. In the illustrated embodiment, each of the linking means 58a, 58b and 58c consists of one linking member 60a, 60b or 60c, respectively. The linking member 60a will be described. A ring-shaped portion 62a is formed at one end of the linking member 60a and rotatably connected to the pin 56. On the other hand, a projecting portion 64a is formed in the free end portion of the upper arm portion 30a of the subsidiary supporting member 4a. A flat plate 68a is fixed to the under surface of the projecting portion 64a via four rollers 66a. Conveniently, the rollers 66a are rotatably mounted. The other end portion of the linking member 60a is inserted between four rollers 66a. More specifically, two of the four rollers 66a are positioned on one side of the linking member 60a, and the other two rollers 66a, on the other side of the linking member 60a. Thus, the other end portion of the linking member 60a is linked movably in the longitudinal direction of the linking member 60a. It will be appreciated therefore that the linking member 60a constituting the linking means 58a is linked to the arm 54 so that it is free to rotate around the central axis of the pin 56 (a fourth axis 70), and the effective linking length l (FIGS. 2 and 4) between the arm 54 and the subsidiary supporting member 4a linked by the linking member 60a can be varied by the relative movement of the linking member 60 through the rollers 66a relative to the subsidiary supporting member 4a.

With reference to FIG. 3, an electrically conductive slip ring 72 is fixed to the uper half of the main shaft 20. On the other hand, three short shafts 74 (only one of which is shown in FIG. 3) are implanted on the upper surface of the central hub portion 8, and current collector brushes 76 are fixed to the short shaft 74, respectively. Current collector brushes 76 are fixed individually to the short shafts 74. Conductors 80 extending through a plug member 78 mounted on the cover member 24 are connected at one end to the slip ring 72, and at the other end to a suitable power supply. Conductors 82 are connected at one end to the current collector brushes 76. The conductors 82 extend along the subsidiary supporting members 4a, 4b and 4c respectively, and connected to the driving means 44a, 44b and 44c. Thus, power is supplied to the driving means 44a, 44b and 44c via the conductors 80, the slip ring 72, the collector brushes 76 and the conductors 82.

Now, the operation of the rotary travelling device described above will be described.

The illustrated rotary travelling device, as shown in FIG. 1, is placed on the travelling surface 22 which is, for example, the surface of concrete to be ground, and the wire brushes 48*a*, 48*b* and 48*c* of the three rotary discs 6*a*, 6*b* and 6*c* are brought into inclined contact with the travelling surface 22. The driving means 44*a*, 44*b* and 44*c* are energized to rotate the rotary discs 6*a*, 6*b* and 6*c* in the direction of arrow 50 in FIG. 2. Since the wire brushes 48*a*, 48*b* and 48*c* of the rotary discs are in inclined contact with the travelling surface 22, when the rotary discs 6*a*, 6*b* and 6*c* are rotated in the direction of arrow 50 in FIG. 2, forces shown by vectors FA, FB and FC act on the rotary discs 6*a*, 6*b* and 6*c* with points A, B and C at which the pressures of contact between the travelling surface 22 and the wire brushes 48*a*, 48*b* and 48*c* are highest, being a center of action, as shown in FIG. 2. The vectors FA, FB and FC respectively have components FA-R, FB-R and FC-R in a direction perpendicular to a straight line connecting the central axis of the main shaft 20, i.e. the first axis 26, to the acting centers A, B and C respectively and components FA-P, FB-P and FC-P in the direction of the straight line. As can be seen by reference to FIG. 2, the vector components FA-R, FB-R and FC-R produce a rotating torque around the first axis 26 as a center, whereby the main supporting member 2 is rotated in the direction shown by an arrow 84 around the first axis 26. On the other hand, the vector components FA-P, FB-P and FC-P produce a propelling force to propel the main shaft 20 in a predetermined direction. As a result, the main shaft 20, and therefore the entire rotary travelling device is caused to travel along the travelling surface 22 in the direction of the resultant force of the vector components FA-P, FB-P and FC-P, i.e. in the direction of a vector F-PT shown in FIG. 5.

Figures 6, 7:
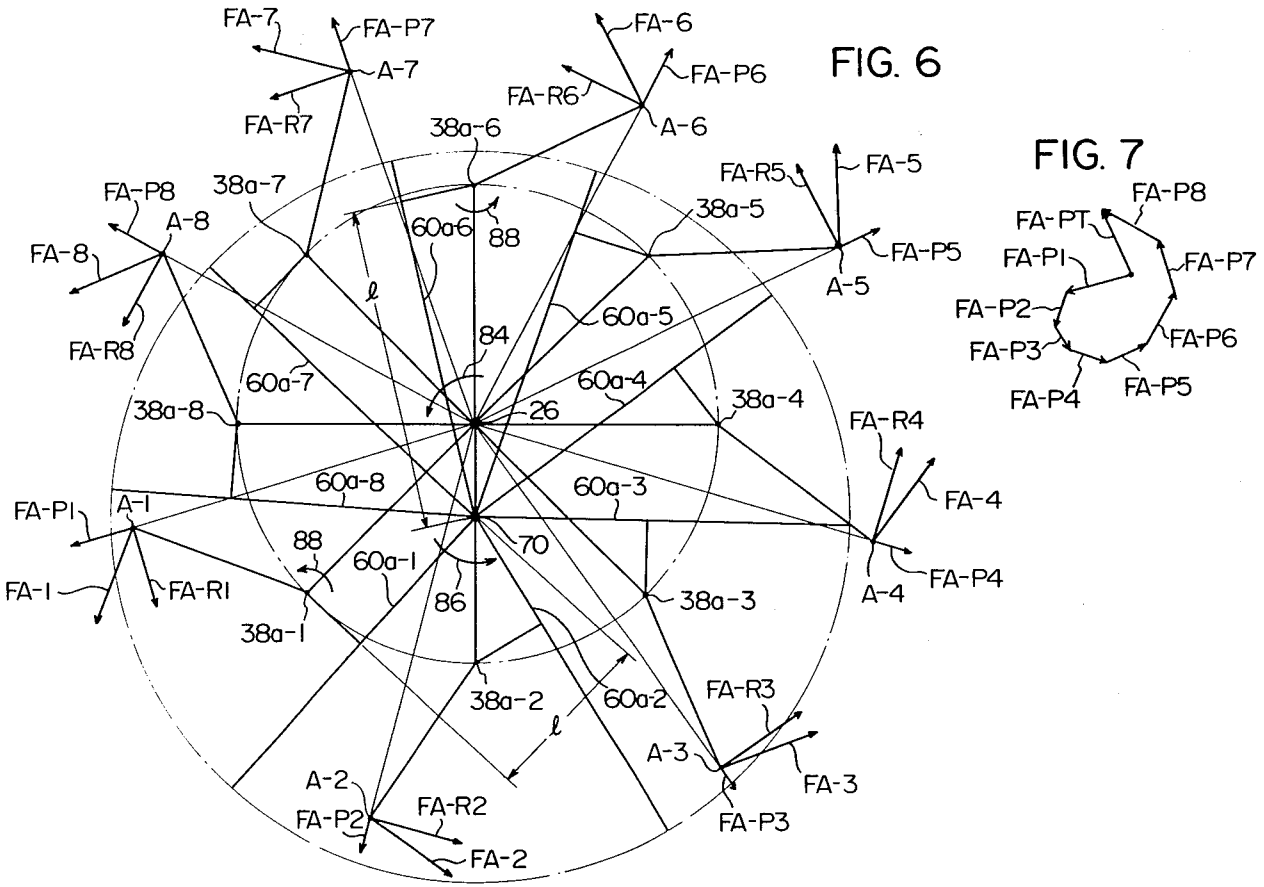
FIG. 6 is a diagrammatic view for illustrating the rotating torques and propelling forces in the rotary travelling device of FIG. 1.
FIG. 7 is a vector diagram, similar to FIG. 5, for illustrating the propelling forces in the rotary travelling device of FIG. 1.

The rotating torque and the propelling force will further be described in detail. FIG. 6 diagrammatically shows how the subsidiary supporting member 4*a* and the rotary disc 6*a* mounted on it move dependently of the rotation of the main supporting member 2 around the first axis 26 as a center. When the main supporting member 2 rotates around the first axis 26 in the direction of arrow 84, the axis of rotation of the subsidiary supporting member 4*a*, i.e. the second axis 38*a*, is rotated around the first axis 26. According to the rotation of the main supporting member 2 at intervals of 45 degrees, the second axis 38*a* is rotated from a position shown by 38*a*-1 in FIG. 6 to positions shown by 38*a*-2, 38*a*-3, 38*a*-4, 38*a*-5, 38*a*-6, 38*a*-7 and 38*a*-8 in FIG. 6. On the other hand, the main shaft 20 does not rotate and therefore, the arm 54 fixed to the main shaft 20 neither rotates. Hence, when the main supporting member 2 and the subsidiary supporting member 4*a* mounted on it rotate in the direction of arrow 84 around the first axis 26, the linking member 60*a* linking the arm 54 to the subsidiary supporting member 4*a* is rotated in a direction shown by an arrow 86 around the central axis of the pin 56 fixed to the arm 54, namely, the fourth axis 70. Consequently, according to the rotation of the main supporting member 2 and the subsidiary supporting member 4*a* on it at intervals of 45 degrees, the linking member 60*a* is rotated from a position shown by 60*a*-1 in FIG. 6 to positions shown by 60*a*-2, 60*a*-3, 60*a*-4, 60*a*-5, 60*a*-6, 60*a*-7 and 60*a*-8 in FIG. 6. The center of rotation of the linking member 60*a*, i.e. the fourth axis 70, and the center of rotation of the main supporting member 2, i.e., the first axis 26, are out of alignment. Accordingly, when the main supporting member 2 and the subsidiary supporting member 4*a* mounted on it are rotated around the first axis 26 in the direction of arrow 84 and the linking member 60*a* is rotated in the direction of arrow 86 around the fourth axis 70, the linking member 60*a* acts as a "crank" whereby the effective linking length l between the arm 54 and the subsidiary supporting member 4*a* by the linking member 60*a* varies and the subsidiary supporting member 4*a* rotates around its own center of rotation, i.e., the second axis 38*a*, in the direction shown by an arrow 88. Since the center of rotation of the rotary disc 6*a*, i.e. the third axis 42*a*, is inclined to the center of rotation of the subsidiary supporting member 4*a*, i.e. the second axis 38*a*, point A at which the pressure of contact between the wire brush 48*a* of the rotary disc 6*a* and the travelling surface 22 is highest changes relative to the rotation of the subsidiary supporting member 4*a* around the second axis 38*a*. Specifically, when the main supporting member 2 is rotated around the first axis 26 in the direction of arrow 84, point A moves from a position shown by A-1 in FIG. 6 to points shown by A-2, A-3, A-4, A-5, A-6, A-7 and A-8 in FIG. 6 according to the rotation of the main supporting member 2 at intervals of 45 degrees. Since the rotary disc 6*a* is rotated in the direction shown by arrow 50 around the third axis 42*a*, forces shown by vectors FA-1 to FA-8 act respectively on the rotary disc 6*a* with points A-1 to A-8 respectively being a center of action. The vectors FA-1 to FA-8 respectively have components FA-R1 to FA-R8 in a direction perpendicular to a straight line connecting the axis of the main shaft 20, i.e. the first axis 26, to the acting centers A-1 to A-8 respectively and components FA-P1 to FA-P8 in the direction of the straight line. It will be understood by reference to FIG. 6 that the vector components FA-R1 to FA-R8 produce a rotating torque around the first axis 26, which causes the main supporting member 2 to rotate in the direction of arrow 84 around the first axis 26. On the other hand, the vector components FA-P1 to FA-P8 produce a propelling force to propel the main shaft 20 in a predetermined direction. By the propelling force, while the main supporting member 2 rotates through one turn around the first axis 26, the entire rotary travelling device is caused to travel along the travelling surface 22 in the direction of the resultant force of the vector components FA-P1 to FA-P8, namely in the direction of a vector FA-PT shown in FIG. 7. It will be readily appreciated that the direction of the vector FA-PT shown in FIG. 7 is the same as the direction of the vector F-PT shown in FIG. 5. While the rotating torque and the propelling force have been described with regard to the subsidiary supporting member 4*a* and the rotary disc 6*a* mounted on it, the same can be said with regard to the rotating torque and the propelling force on the subsidiary supporting member 4*a* and the rotary disc 6*b* mounted on it and the subsidiary supporting member 4*c* and the rotary disc 6*c* mounted on it.

When in the rotary travelling device described above, the rotary discs 6*a*, 6*b* and 6*c* are rotated in a direction opposite to the direction shown by arrow 50 by the driving means 44*a*, 44*b* and 44*c*, the main supporting member 2 is rotated around the first axis 26 in a direction opposite to the direction of arrow 84. The subsidiary supporting members 4*a*, 4*b* and 4*c* are rotated around the second axis 38*a* in a direction opposite to the direction of arrow 88 while it is revolved around the first axis 26 in a direction opposite to the direction of arrow 84. The propelling force produced at this time is in a direction opposite to the direction of the vector F-PT shown in FIG. 5, and therefore the entire rotary travelling device is caused to travel along the travelling surface 22 in a direction opposite to that described hereinabove.

It will be understood by reference to FIGS. 5 to 7 in conjunction with FIG. 2 that the travelling direction of the rotary travelling device (i.e., the direction of the vector F-PT shown in FIG. 5) forms a predetermined angle $\alpha$ with respect to the projecting direction of the arm 54 from the first axis 26. Accordingly, when the main shaft 20 is rotated around the first axis 26 by operating the handle 24 and consequently, the projecting direction of the arm 54 from the first axis 26 is varied, the direction of the vector F-PT shown in FIG. 5 varies accordingly and therefore the travelling direction of the rotary travelling device also varies. Thus, the travelling direction of the rotary travelling device can be controlled as desired by operating the handle 24. In the illustrated embodiment, the travelling direction of the rotary travelling device, namely the direction of the vector F-PT shown in FIG. 5, forms a predetermined angle $\beta$ with respect to the extending direction of the handle 24, as can be seen from FIGS. 2 and 5. In order to control the travelling direction easily, the angle of securing the handle 24 to the main shaft 20 can also be prescribed such that the handle 24 extends in the travelling direction of the rotary travelling device or in a direction reverse to it.

The angle $\alpha$ formed between the projecting direction of the arm 54 from the first axis 26 and the travelling direction of the rotary travelling device depends upon the angle $\gamma$ formed between the extending direction of the upper arm portion 30*a*, 30*b* or 30*c* in the subsidiary supporting member 4*a*, 4*b* or 4*c* (therefore, the position A, B or C) and the projecting direction of the projecting portion 64*a*, 64*b* or 64*c* (therefore, the linking position of the linking member 60*a*, 60*b* or 60*c*). If, for example, the above angle $\gamma$ is substantially 180 degrees, the angle $\alpha$ becomes substantially 90 degrees. To add, the production of the propelling force shown by the vector F-PT in FIG. 5 in the rotary travelling device in accordance with this invention is attributed to the fact that the axes of rotation of the rotary discs 6*a*, 6*b* and 6*c*, i.e. the third axes 42*a*, 42*b* and 42*c*, are not perpendicular, but inclined, to the travelling surface 22, and that when the subsidiary supporting members 4*a*, 4*b* and 4*c* revolve around the first axis 26, they also rotated around the second axes 38*a*, 38*b* and 38*c* by the action of the subsidiary supporting member rotating means 52. It will be understood by reference to FIGS. 2 and 5 to 7 that when the axes of rotation of the rotary disc, i.e. the third axes 42*a*, 42*b* and 42*c*, are substantially perpendicular to the travelling surface 22, and/or the subsidiary supporting members 4*a*, 4*b* and 4*c* are not rotated around the second axes 38*a*, 38*b* and 38*c*, a propelling force to travel the rotary travelling force along the travelling surface 22, namely the vector F-PT shown in FIG. 5, is not produced.

In the rotary travelling device of this invention described hereinabove, rotation of the rotary discs 6*a*, 6*b* and 6*c* around the third axes 42*a*, 42*b* and 42*c* in the direction of arrow 50 and rotation of the rotary discs 6*a*, 6*b* and 6*c* around the first axis 26 in the direction of arrow 84 incident to the rotation of the main supporting member 2 in the direction of arrow 84 cause the wire brushes 48*a*, 48*b* and 48*c* of the rotary discs 6*a*, 6*b* and 6*c* to act on the travelling surface 22 and grind it. In addition, by the propelling force shown by vector F-PT in FIG. 5, the rotary travelling device automatically travels along the travelling surface 22 in a required direction. As a result, the travelling surface 22 is automatically ground sufficiently uniformly.

Figure 8:
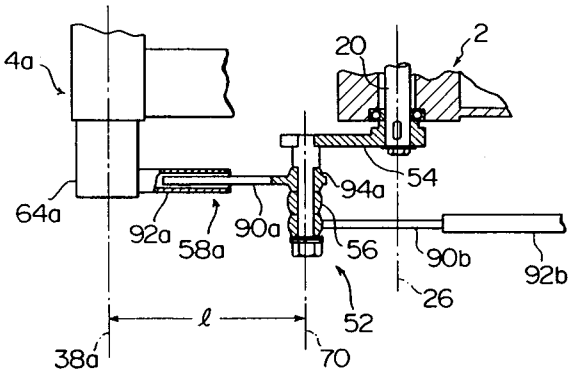
FIG. 8 is a sectional view; similar to FIG. 4, showing a modified embodiment of the linking means of the subsidiary supporting member rotating means in the rotary travelling device of FIG. 1.

FIG. 8 shows a modified embodiment of the linking means 58*a* (58*b*, and 58*c*) in the subsidiary supporting member rotating means 52. The linking means 58*a* in FIG. 8 is comprised of a first linking member 90*a* in the shape of a round rod and a second linking member 92*a* of a cylindrical shape. A ring-like portion 94*a* is formed at one end portion of the first linking member 90*a*, and the ring-member 94*a* is mounted rotatably on the pin 56 fixed to the arm 54. The other end portion of the first linking member 90*a* is slidably inserted in the second linking member 92*a*, whereby the other end portion of the first linking member 90*a* and one end portion of the second linking member 92*a* are connected such that they are free to move longitudinally of the first linking member 90*a* and the second linking member 92*a*. The other end portion of the second linking member 92*a* is fixed to the projecting portion 64*a* of the subsidiary supporting member 4*a*. When the main supporting member 2 is rotated around the first axis 26 in this linking means 58*a*, the first and second linking members 90*a* and 92*a* are rotated around the central axis of the pin 56, i.e. the fourth axis 70, and the first linking member 90*a* and the second linking member 92*a* move relative to each other longitudinally thereof whereby the effective length l of linking between the arm 54 and the subsidiary supporting member 4*a* varies. Consequently, when the main supporting member 2 and the subsidiary supporting member 4*a* mounted on it are rotated around the first axis 26, the subsidiary supporting member 4*a* is rotated around the second axis 38*a*.

Figure 9:
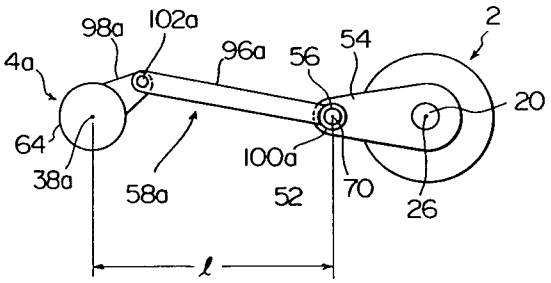
FIG. 9 is a bottom view showing another embodiment of the linking means of the subsidiary supporting member rotating means in the rotary travelling device of FIG. 1.

FIG. 9 shows still another modified embodiment of the linking means 58*a* (58*b* and 58*c*) in the subsidiary supporting member rotating means 52. The linking means 58*a* shown in FIG. 9 is comprised of a first linking means 96*a* and a second linking member 98*a*. A ring-like portion 100*a* is formed in one end portion of the first linking member 96*a*, and the ringlike portion 100*a* is rotatably mounted on the pin 56 fixed to the arm 54. The other end portion of the first linking member 96*a* is rotatably connected to one end portion of the second linking member 98*a* by means of a linking pin 102*a*. The other end portion of the second linking member 98*a* is fixed to the projecting portion 64*a* of the subsidiary supporting member 4*a*. When the main supporting member 2 is rotated around the first axis 26 in this linking means 58*a*, the first linking member 96*a* is rotated around the central axis of the pin 56, i.e. the fourth axis 70, and the second linking member 98*a* is rotated around the linking pin 102*a* relative to the first linking member 96*a* to vary the effective length l of linking between the arm 54 and the subsidiary supporting member 4*a*. As a result, when the main supporting member 2 and the subsidiary supporting member 4*a* mounted on it are rotated around the first axis 26, the subsidiary supporting member 4*a* is also rotated around the second axis 38*a*.

While the rotary travelling device constructed in accordance with this invention has been described in detail with reference to its preferred embodiment, it should be understood that the invention is not limited to these specific embodiments and various changes and modifications are possible without departing from the scope of the invention.

For example, in the illustrated embodiments, three subsidiary supporting members having rotary discs mounted thereon are mounted on the main supporting member. The number of such subsidiary supporting members may be 1, 2 or 4. When 1 or 2 subsidiary supporting members having a rotary disc are used, it is possible to attach a suitable frame to the main supporting member or the main shaft and mount on the frame a plurality of suitable wheels rotataing freely in contact with the travelling surface in order that the rotary travelling device may travel stably without tumbling.

In the illustrated embodiments, the driving means for rotating the rotary disc is provided in each of the three subsidiary supporting members. If desired, however, it is possible to provide one common driving source in the main supporting member, and link the common driving source drivingly to the three rotary discs mounted on the three subsidiary supporting member via a suitable transmission mechanism.

When the travelling surface to be treated by grinding or otherwise is not horizontal but vertical or inclined, it is possible to mount a suitable partitioning wall defining a pressure-reduced space in cooperation with the travelling surface on, for example, the circular plate of the rotary disc, cause the pressure-reduced space to communicate with a pressure reduction source such as a vacuum pump, and thereb to attract the rotary travelling device by vacuum to the travelling surface. One preferred example of the partitioning wall that can be used for this purpose is disclosed in U.S. Pat. No. 4,095,378 to the present inventor.

What is claimed is:

1. A rotary travelling device comprising a main supporting member rotatable around a first axis extending substantially perpendicularly to a travelling surface, a subsidiary supporting member mounted on the main supporting member for free rotation around a second axis extending substantially parallel to the first axis, a rotary disc mounted on the subsidiary supporting member for free rotation around a third axis extending inclinedly to the second axis, the under surface of the rotary disc being adapted to come into inclined contact with the travelling surface, a driving means for rotating the rotary disc around the third axis, and means for rotating the subsidiary supporting member around the second axis according to the rotation of the main supporting member around the first axis.

2. The rotary travelling device of claim 1 wherein a plurality of subsidiary supporting members are mounted on the main supporting member at substantially equiangular intervals, the distances from the subsidiary supporting members to the first axis are substantially equal, and said rotary disc is mounted on each of the subsidiary supporting member.

3. The rotary travelling device of claim 2 wherein said driving means is mounted on each of the subsidiary supporting members.

4. The rotary travelling device of claim 1 wherein said means for rotating the subsidiary supporting member includes an arm mounted on the main supporting member for rotation relative to the main supporting member around the first axis and a linking means for linking the arm to the subsidiary member; the linking means is linked to the arm so that it is free to rotate around a fourth axis extending substantially parallel to the first axis and spaced a predetermined distance from the first axis, and the effective length of linking between the arm and the subsidiary member by the linking means is variable according to the rotation of the main supporting member around the first axis.

5. The rotary travelling device of claim 4 wherein the linking means consists of one linking member one end portion which is linked to the arm rotatably around the fourth axis and the other end portion of which is linked to the subsidiary supporting member movably longitudinally of the linking member.

6. The rotary travelling device of claim 4 wherein the linking means consists of a first linking member and a second linking member, one end portion of the first linking member is linked to the arm rotatably around the fourth axis, the other end portion of the first linking member and one end portion of the second linking member are linked movably longitudinally of the first and second linking members, and the other end portion of the second linking member is fixed to the subsidiary supporting member.

7. The rotary travelling device of claim 4 wherein the linking means consists of a first linking member and a second linking member, one end portion of the first linking member is linked to the arm rotatably around the fourth axis, the other end portion of the first linking member and one end portion of the second linking member are rotatably linked, and the other end portion of the second linking member is fixed to the subsidiary supporting member.

8. The rotary travelling device of claim 4 wherein a travelling direction controlling handle is connected to the arm to rotate the arm around the first axis.

9. The rotating travelling device of claim 1 wherein means for treating the travelling surface is provided on the under surface of the rotary disc.

10. The rotary travelling device of claim 9 wherein the treating means is a wire brush.

* * * * *